US010276938B2

(12) United States Patent
Ghit et al.

(10) Patent No.: US 10,276,938 B2
(45) Date of Patent: Apr. 30, 2019

(54) MOBILE TERMINAL DEVICE

(71) Applicants: Chan Yun Ghit, Shenzhen (CN); Ng Guan Hong, Shenzhen (CN); Tay Yew Siow, Shenzhen (CN); Tan Yew Choon, Shenzhen (CN)

(72) Inventors: Chan Yun Ghit, Shenzhen (CN); Ng Guan Hong, Shenzhen (CN); Tay Yew Siow, Shenzhen (CN); Tan Yew Choon, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 460 days.

(21) Appl. No.: 15/062,057

(22) Filed: Mar. 5, 2016

(65) Prior Publication Data

US 2017/0033437 A1 Feb. 2, 2017

(30) Foreign Application Priority Data

Jul. 31, 2015 (CN) ..... 2015 1 0463929

(51) Int. Cl.
*H01Q 1/02* (2006.01)
*H01Q 9/04* (2006.01)
*H01Q 1/24* (2006.01)

(52) U.S. Cl.
CPC ..... *H01Q 9/0421* (2013.01); *H01Q 1/243* (2013.01)

(58) Field of Classification Search
CPC ..... H01Q 9/0421
USPC ..... 343/702
See application file for complete search history.

(56) References Cited

U.S. PATENT DOCUMENTS

2009/0153412 A1* 6/2009 Chiang ..... H01Q 1/52 343/702
2009/0231215 A1* 9/2009 Taura ..... H01Q 1/243 343/702
2016/0093955 A1* 3/2016 Ayala Vazquez .... H01Q 9/0442 343/702

* cited by examiner

*Primary Examiner* — Dameon E Levi
*Assistant Examiner* — David E Lotter
(74) *Attorney, Agent, or Firm* — Na Xu; IPro, PLLC

(57) ABSTRACT

A mobile terminal device is disclosed. The mobile terminal device includes a metal rear cover; a metal frame forming an accommodation space with the metal rear cover; a printed circuit board assembly; and an antenna module inside the accommodation space and electrically connected with the printed circuit board assembly. The antenna module includes a grounding terminal and a feeding point disposed on the printed circuit board assembly. The metal rear cover includes a first metal part, a second metal part, a third metal part and the two coupled gap. The first metal part and the third metal part are connected to both ends of the second metal part.

8 Claims, 5 Drawing Sheets

MOBILE TERMINAL DEVICE

FIELD OF THE INVENTION

The present invention relates to mobile communication technology field.

DESCRIPTION OF RELATED ART

At present, with the popularity of the mobile terminal device intelligentization, the consumer has higher and higher demands on the beautiful appearance in various mobile terminal devices, and the metal based beautiful wearing features, and the qualified luster and hand feeling are recognized by consumers day by day, so the appearance design of the mobile terminal device has been gradually upgraded from a cheap plastic material to the whole metal body.

The appearance design of this metal rear cover is very good for the designer and the terminal user's experience, but there is a challenge for antenna engineers, because the electromagnetic wave cannot penetrate the metal. A fully enclosed metal rear cover is not feasible for the antenna radiation, because it will directly destroy the antenna module signal's strength, and affect the usage experience of the mobile terminal device user.

Therefore, it is necessary to provide a new mobile terminal device to overcome the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
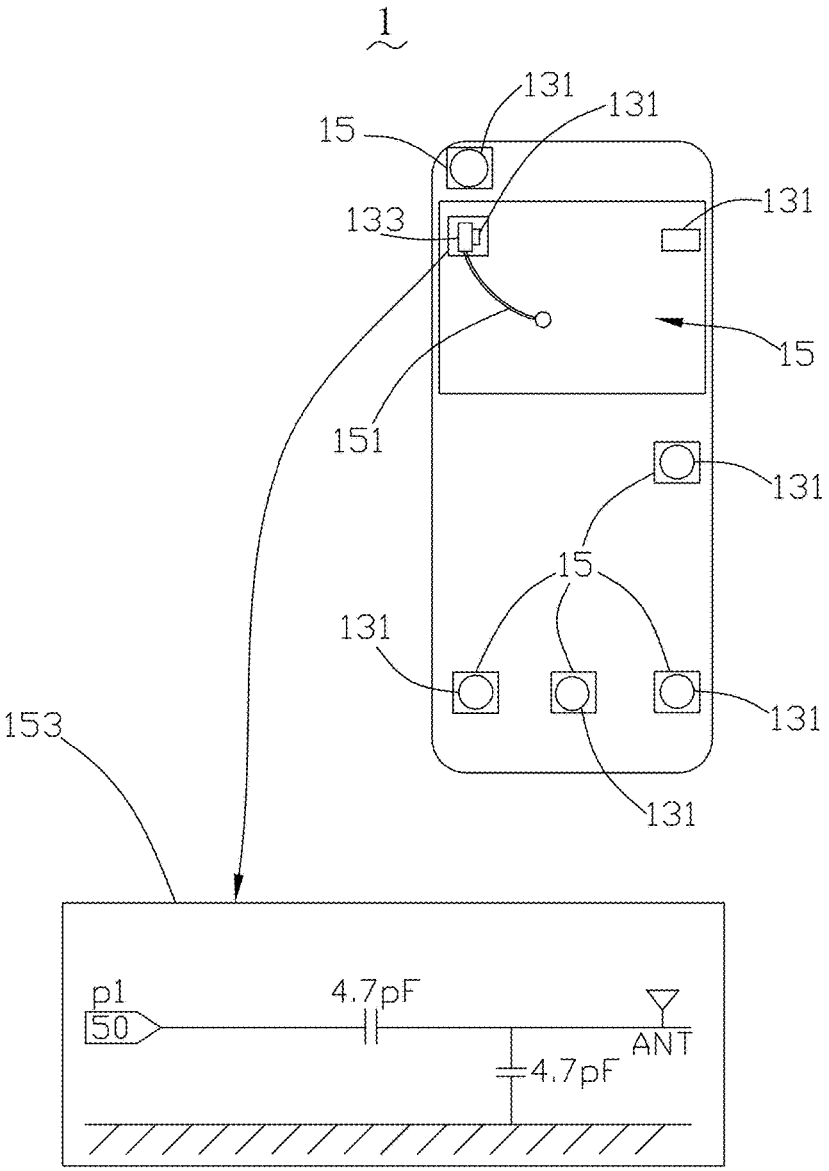
FIG. 1 is a front view of a mobile terminal device in accordance with an exemplary embodiment of the present disclosure.
Figure 2:
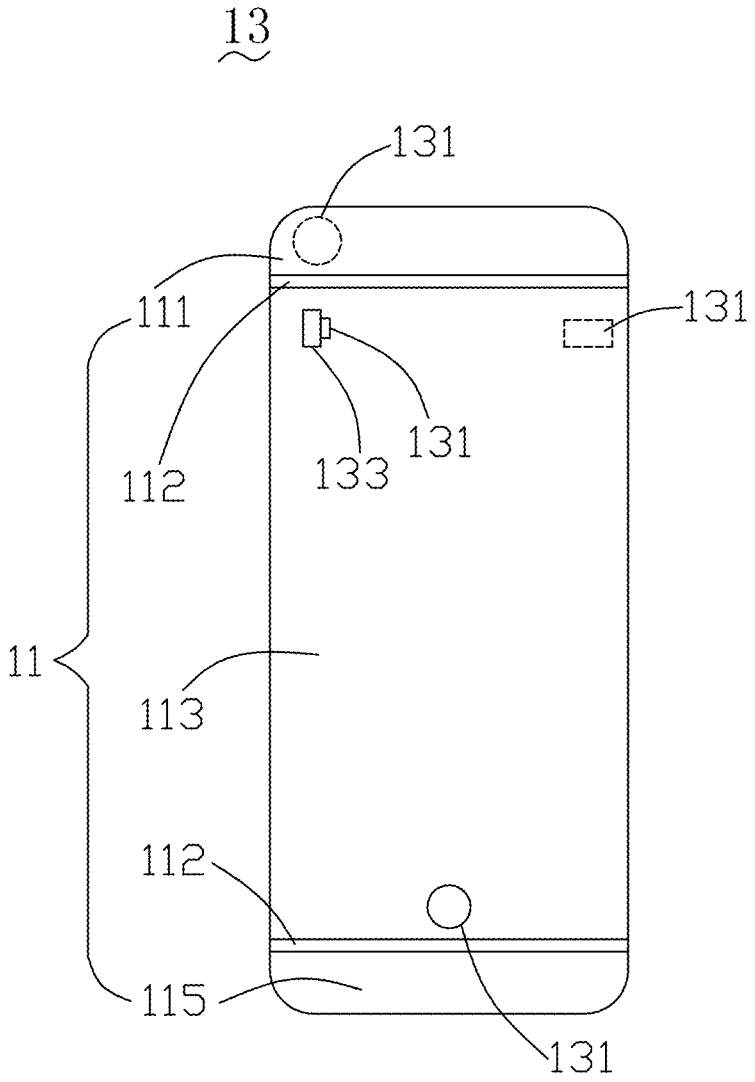
FIG. 2 is a rear view of the mobile terminal device in FIG. 1.

Referring to FIGS. 1-2, a mobile terminal device 1 in accordance with an exemplary embodiment of the present disclosure includes a metal rear cover 11, a metal frame (not shown) forming an accommodation space jointly with the metal rear cover 11, an antenna module 13, and a printed circuit board assembly 15. The antenna module 13 is set alternately with the printed circuit board assembly 15 oppositely, and the two are electrically connected and are both received in the accommodation space of the mobile terminal device 1.

The metal rear cover 11 comprises a first metal part 111, a second metal part 113, a third metal part 115 and a second-coupled gap 112, while the first metal part 111, and the third metal part 115 are set with the both ends of the second metal part 113 alternately through the coupled gap 112. The width of the coupled gap 112 is 1.5 mm mm-2.0 which is filled by adopting non-metallic materials.

In the embodiment, the antenna module 13 is a GPS antenna module, wherein the working frequency band of the GPS antenna module is 1565-1615 MHz. Of course, in other alternative embodiment, the antenna module 13 can also be a variety of other antenna modules, such as Bluetooth antenna module, Wi-Fi antenna module, multi band telephone transceiver antenna module, FM radio antenna module, etc.

The antenna module 13 includes a radiator, a grounding terminal 131 and a feeding point 133. In the disclosure, the radiator of the antenna module 13 is the first metal part 111, the second metal part 113 and the third metal part 115. The grounding terminal 131 and the feed point 133 are respectively arranged on the surface of the printed circuit board assembly 15 and electrically connected with the metal rear cover 11.

Figure 3:
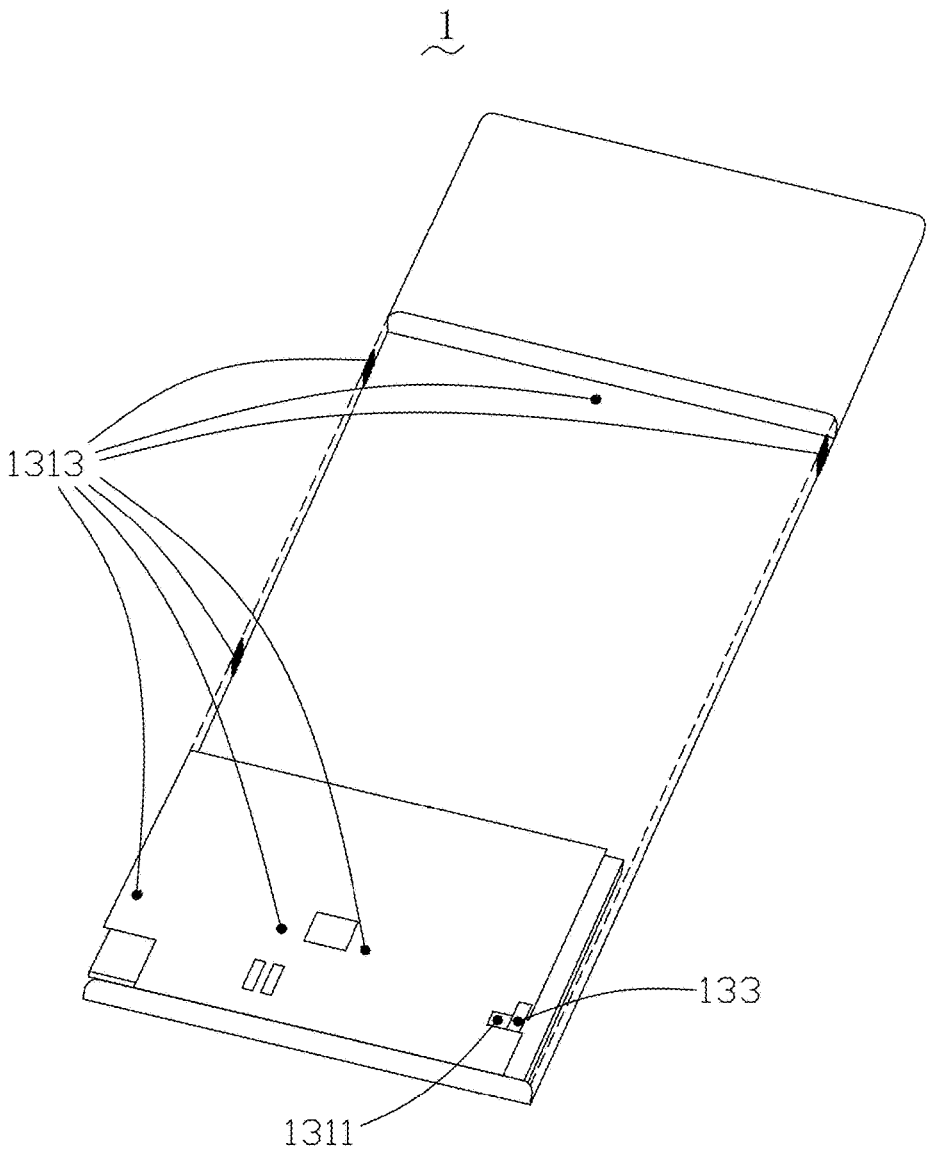
FIG. 3 shows a relative position relationship of a main grounding point, an auxiliary grounding point and a feeding point of an antenna module of the mobile terminal device in FIG. 1.

Referring to FIG. 3, in the embodiment, the amount of the grounding terminal 131 can be more than one and the grounding terminal 131 includes a main grounding point 1311 and a plurality of auxiliary grounding points 1313 separately from each other, and the grounding terminal 131 is electrically connected to the metal rear cover 11 through the main grounding point 1311 and the auxiliary grounding points 1313. The structure of the antenna module 13 gets optimized by the separate layout design of the main grounding point 1311, the plurality of auxiliary points 1313 and the feed point 133.

The printed circuit board assembly 15 is used to carry the structure of the antenna module 13. The printed circuit board assembly 15 includes a feeder 151 and a matching circuit 153 electrically connected to the feeder 151. The matching circuit 153 comprises an inductor and a capacitor, while the matching circuit 131 is electrically connected with the grounding terminal 153 and the feed point 133 respectively. The feed line 151 is a coaxial cable of fifty ohm, which can effectively transmit the electric wave to the antenna interface, and the feed point 151 is electrically connected to the metal rear cover 11 via the feeder 133.

The metal rear cover 11 and the printed circuit board assembly 15 form a resonant circuit, thereby forming an effective radiation space to improve the signal response of the antenna module 13. The grounding terminal 131 and the feed point 133 are used to control the resonant frequency of the antenna module 13. The grounding terminal 1313 is electrically connected to the metal rear cover 11 via the main grounding point 1311 and the auxiliary grounding point 133, and the feed point 151 is electrically connected to the metal rear cover 11 via the feeder 131, thereby forming a signal transmission line of the antenna module 13.

Figure 4:
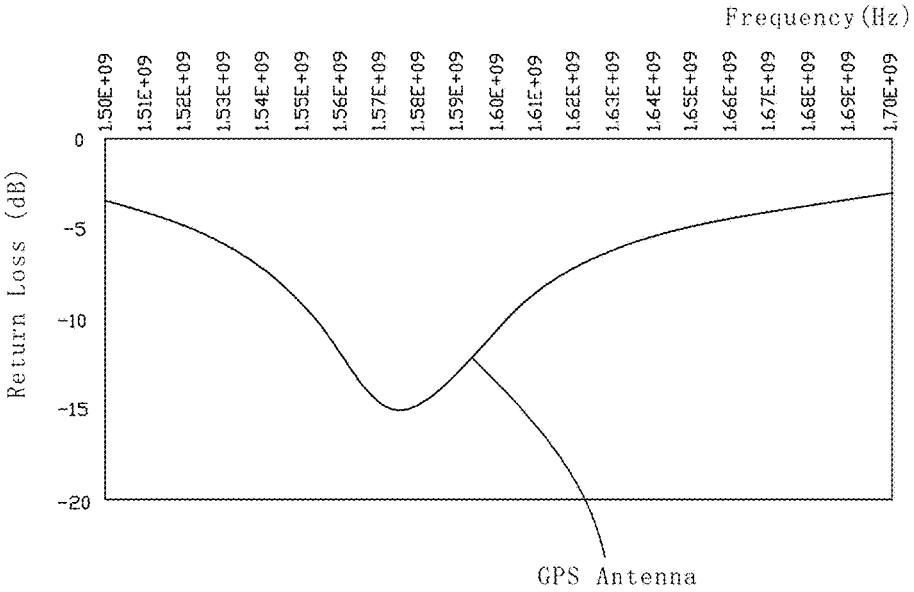
FIG. 4 is a testing diagram of the return loss of the antenna module of the mobile terminal device.
Figure 5:
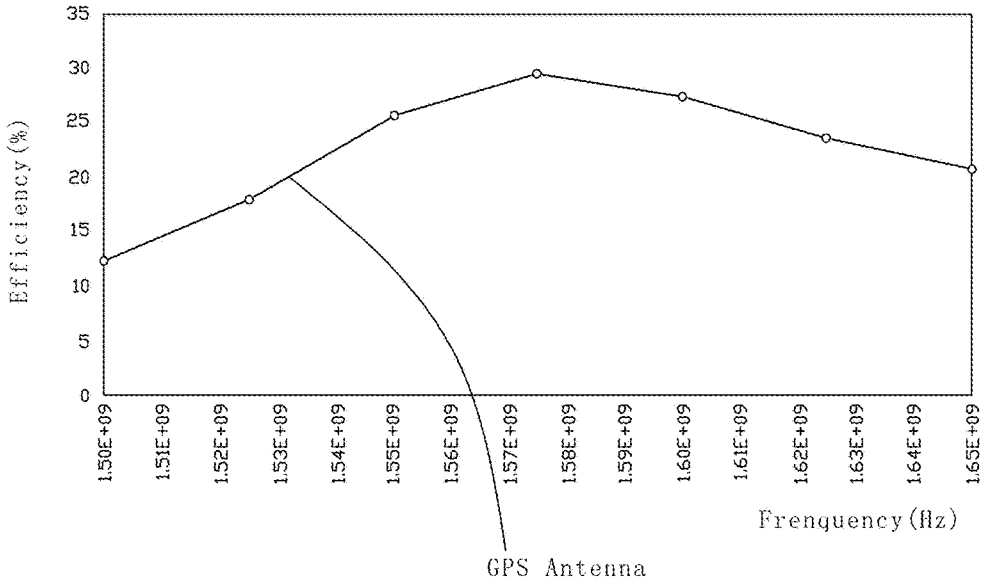
FIG. 5 is a testing diagram of the efficiency of the antenna module of the mobile terminal device.

FIG. 4 shows the return loss test of the antenna module of the mobile terminal device. FIG. 5 shows the efficiency test of the antenna module of the mobile terminal device.

For the mobile terminal device provided by this scheme during usage, the working frequency band of the antenna module 13 is 1565-1615 MHz for the mobile terminal device 1, and the return loss within the working frequency band is −8~−15 dB, with the efficiency able to reach 24%~30%. It is known that this scheme improves the efficiency and reduces the return loss after optimizing the structure of the antenna module 13.

The mobile terminal device 1 provided by the disclosure has the following beneficial effect:

I. Through adding second-coupled gap 112 and controlling the width and filling materials of the second-coupled gap 112, the metal rear cover 11 of the mobile terminal device 1 becomes not completely closed to effectively enhance the signal radiation and improve the signal intensity of the antenna module 13, and improve the efficiency of the antenna frequency band till 24%-30%, and reduce the return loss of the antenna module 13.

II. By the dispersed layout design of the main grounding point 1311, multiple auxiliary grounding points 1313 and feeding point 133 of the grounding terminal 131, the structure of the antenna module 13 gets optimized.

III. Through the metal rear cover 11 at least in part as the radiator of the antenna module 13, the area of the radiator gets increased, forming an effective radiation space and improving the response signal of the antenna module 13 and improving the user's experience of the mobile terminal device 1.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile terminal device, comprising: a metal rear cover; a metal frame forming an accommodation space with the metal rear cover; a printed circuit board assembly; an antenna module inside the accommodation space and electrically connected with the printed circuit board assembly, the antenna module including a grounding terminal and a feeding point disposed on the printed circuit board assembly; wherein at least part of the metal rear cover serves as a radiator of the antenna module, the radiator includes a first metal part, a second metal part, a third metal part and the two coupled-gag gaps, the first metal part and the third metal part are connected to both ends of the second metal part alternately through the coupled gap, the second metal part is separated from the first metal part and connected to the first metal part merely through one of the coupled gaps, the second metal part is separated from the third metal part and connected to the third metal part merely through another one of the coupled gaps, the grounding terminal comprises a main grounding point and at least one auxiliary grounding point, while the grounding terminal through the main grounding point is connected to the metal rear cover, the feeding point is connected electrically with the metal rear cover; and the coupled gaps are filled by adopting non-metallic materials.

2. The mobile terminal device as described in claim 1, wherein the grounding terminal includes a plurality of auxiliary grounding points disposed separately from each other, and the grounding terminal is electrically connected with the metal rear cover via the auxiliary grounding points.

3. The mobile terminal device as described in claim 1, wherein the printed circuit board assembly comprises a feeder and a matching circuit, wherein the matching circuit is electrically connected with the grounding terminal and the feeding point respectively, and the feeding point is electrically connected to the metal rear cover via the feeder.

4. The mobile terminal device as described in claim 1, wherein the coupled gaps have a width of 1.5 mm-2.0 mm.

5. The mobile terminal device as described in claim 1, wherein the first metal part, the second metal part and the third part are the radiators of the antenna module.

6. The mobile terminal device as described in claim 1, wherein a working frequency of the antenna module is 1565-1615 MHz.

7. The mobile terminal device as described in claim 3, wherein the matching circuit comprises an inductor and/or a capacitor.

8. The mobile terminal device as described in claim 1, wherein the antenna module is a GPS antenna module.

* * * * *